US008065883B2

(12) United States Patent
Pozivil

(10) Patent No.: US 8,065,883 B2
(45) Date of Patent: Nov. 29, 2011

(54) CONTROLLED STORAGE OF LIQUEFIED GASES

(75) Inventor: Josef Pozivil, Allschwil (CH)

(73) Assignee: The BOC Group plc (GB)

( * ) Notice: Subject to any disclaimer, the term of this patent is extended or adjusted under 35 U.S.C. 154(b) by 1111 days.

(21) Appl. No.: 10/569,379

(22) PCT Filed: Sep. 1, 2004

(86) PCT No.: PCT/IB2004/003012

§ 371 (c)(1),
(2), (4) Date: Oct. 24, 2006

(87) PCT Pub. No.: WO2005/022027

PCT Pub. Date: Mar. 10, 2005

(65) Prior Publication Data

US 2007/0068176 A1 Mar. 29, 2007

(30) Foreign Application Priority Data

Sep. 1, 2003 (GB) ..... 0320474.0

(51) Int. Cl.
*F17C 7/02* (2006.01)

(52) U.S. Cl. ..... 62/50.1; 62/45.1; 62/47.1; 62/48.1; 62/48.2; 62/50.7

(58) Field of Classification Search ..... 62/45.1, 62/50.1, 47.1, 48.1, 48.2, 50.7
See application file for complete search history.

(56) References Cited

U.S. PATENT DOCUMENTS 3,191,395 A * 6/1965 Maher et al. ..... 62/47.1
3,254,498 A * 6/1966 Becker ..... 62/45.1
3,453,836 A * 7/1969 Kerr ..... 62/47.1
3,809,153 A * 5/1974 Kober ..... 165/62
3,918,265 A 11/1975 Etzbach et al.
4,141,224 A * 2/1979 Alger et al. ..... 62/50.1
4,489,569 A * 12/1984 Sitte ..... 62/49.2
5,150,578 A * 9/1992 Oota et al. ..... 62/47.1
5,360,139 A * 11/1994 Goode ..... 222/40
5,465,583 A * 11/1995 Goode ..... 62/50.2
6,644,039 B2 * 11/2003 Hughes et al. ..... 62/49.1

FOREIGN PATENT DOCUMENTS

EP 1 120 615 A2 1/2001
FR 2792707 10/2000
WO WO 98/59195 12/1998

OTHER PUBLICATIONS

British Search Report of Application. No. GB 0320474.0 dated Feb. 9, 2004, 1 page.

* cited by examiner

*Primary Examiner* — Cheryl J Tyler
*Assistant Examiner* — John Pettitt
(74) *Attorney, Agent, or Firm* — Joshua L. Cohen

(57) ABSTRACT

A method and apparatus for the controlled storage of liquefied gases such as liquefied natural gas in an enclosed insulated container, in which part of the liquid is withdrawn and fed to an external refrigeration unit for subcooling and the subcooled liquid is reintroduced into the container via one or more valve-controlled headers under the control of a control system operated in response to pressure and temperature signals from within the container, wherein the level of subcooling is matched to the heat inleak into the container and most or all of the subcooled liquid is reintroduced directly into the stored liquid so as to maintain stable conditions in the stored liquid and to minimise evaporation thereof.

20 Claims, 1 Drawing Sheet

CONTROLLED STORAGE OF LIQUEFIED GASES

National Stage application of International Application No. PCT/IB2004/003012 filed Sep. 1, 2004, which claims priority to British Application No. GB 0320474.0 filed Sep. 1,2003.

BACKGROUND OF THE INVENTION

This invention relates to a method and apparatus for controlling the storage conditions of liquefied gases. It is of particular reference and benefit to the storage of liquefied natural gas (LNG) in ocean-going tankers.

Storing and transporting in liquid form such gases as natural gas and atmospheric gases offers considerable benefits in the large quantities that may be stored or transported in a given size of container. The low temperatures of such cryogenic liquids do however impose many severe requirements upon the container's design and operation. The container must be mechanically strong and capable of withstanding the low storage temperatures and the expansion and contraction stresses on heating and cooling between storage and ambient temperatures. It must be substantially if not entirely enclosed and provide a high level of insulation so as to minimise heat inleak and the resultant evaporation of the liquid.

The established use of a double-walled container with an interspace between the walls helps to achieve low heat inleak, and can be made more effective by the use of vacuum or other insulation in the interspace. Some heat inleak is nevertheless inevitable, leading to evaporation of the liquid. The heat inleak tends to cause a thermosyphon action within the container, liquid adjacent to the walls being warmed by the heat inleak and thereby becoming less dense and rising towards the surface. The upward movement adjacent to the walls correspondingly tends to impose a downward movement on the liquid at or near the centre of the container. The thermosyphon action makes it difficult to control the storage conditions. In particular when the warmer liquid rising near the walls reaches the surface it tends to boil, creating additional vapour and increasing the headspace pressure .

Additional means are generally required to reliquefy or otherwise deal with the vapours resulting from heat inleak. Venting of the evaporated material is generally undesirable and especially so in the case of natural gas because of its flammability and because its methane content and any other hydrocarbons it contains each function as greenhouse gases.

Various proposals have been made for retaining vapours within the container envelope. U.S. Pat. No. 3,918,265 describes an early process for reducing refrigeration losses from a plurality of storage compartments for low temperature liquid mixtures such as LNG, in which process liquid mixture is withdrawn from one of the compartments, is subcooled and then recycled into all of the storage compartments, with the proviso that a large portion of the subcooled mixture is recycled into the storage compartment from which the liquid mixture is withdrawn. The refrigeration value of the subcooled liquid is said to be sufficient to compensate for the loss of refrigeration values due to heat from the surroundings.

Introduction of a subcooled liquid as proposed by the said patent tends to add to the problems of maintaining controllable conditions within the container. For example the recycling of subcooled liquid may so inhibit the evaporation as to create a partial vacuum in the container's ullage space, with attendant risks of drawing in external materials. Drawing atmospheric oxygen into the container is particularly to be avoided because of the danger that it could lead to a combustible or explosive mixture within the container. A related problem is that the partial vacuum may impose undue stress on the container structure.

The recycling of subcooled liquid may also encourage stratification within the stored liquid. The subcooled material being more dense than the stored bulk tends to sink to form a dense lower layer and to encourage the formation of successively lighter layers towards the liquid surface. The light top layer is then particularly prone to evaporation. Moreover the evaporation of the lighter fractions from the top layer increases its density relative to the lower layers and can lead to a sudden rollover and mixing of the layers which may result in a violent boiling action.

Solutions for controlling vapours resulting from heat inleak have therefore generally been sought in reliquefying the vapours and returning them to the stored bulk. These introduce other problems with LNG, which is primarily a mixture of methane and nitrogen, in that the composition of the vapour (otherwise known as "boil off") is different from that of the liquid and generally has a much higher proportion of nitrogen. The higher the nitrogen content of the boil off, the more difficult is its reliquefaction. The nitrogen content of the boil off varies according to the composition of the transported LNG. The higher the mole fraction of nitrogen in the boil off the lower is the pressure and temperature to which the refrigerant is expanded in order to achieve its total reliquefaction.

Reducing the pressure to which the refrigerant is expanded leads to a larger and more costly refrigerator with higher power consumption. Indeed, since the nitrogen content of the boil off can fluctuate quite appreciably dependent on the transported LNG composition, in order to be sure of totally liquefying the boil off, the refrigerator has to be designed in order to meet the least favourable circumstances, as may exist in the LNG spot market. The conventional solution to this problem is to vent a part of the boil off and therefore restrict the size of the refrigerator. As mentioned above, this solution is environmentally unacceptable. It must be also noted here, that the refrigerator for reliquefying vapour must handle the vapour compression heat in addition to the heat inleak only. This increases the refrigerator size by 20 to 30%.

Moreover because the reliquefied natural vapours have a higher nitrogen content they have a higher density than the stored bulk. This further increases the likelihood of stratification as the heavy recycled material sinks towards the bottom of the container.

SUMMARY OF THE INVENTION

The present invention has the objective of utilising subcooling in a predictable and stable manner in the storage of liquefied gases.

Accordingly, in one aspect, the present invention provides apparatus for the controlled storage of liquefied gases which comprises an enclosed insulated container providing a liquid space and an ullage space and having an external refrigeration unit, means for withdrawing part of the liquid and feeding it to the refrigeration unit for subcooling and one or more headers for reintroducing the subcooled liquid into the container, characterised in that the ullage space contains at least one valve-controlled header and at least one pressure sensor, in that the liquid space contains at least one valve-controlled header and at least one temperature sensor and in that the apparatus further includes a control system to operate the header valves in response to signals from the pressure and temperature sensors.

In a further aspect, the present invention provides a method for the controlled storage of liquefied gases in an enclosed insulated container providing a liquid space and an ullage space wherein part of the liquid is withdrawn and subcooled in an external refrigeration unit from which the subcooled liquid is reintroduced into the container via one or more headers, characterised in that the pressure in the ullage space is monitored by at least one pressure sensor therein and the temperature in the liquid space is monitored by at least one temperature sensor therein, signals from the said sensors being fed to a control system which operates at least one valve-controlled header in the ullage space and at least one valve-controlled header in the liquid space to reintroduce subcooled liquid into the ullage space and/or the liquid space.

The invention is of particular relevance to the storage of LNG in ocean-going tankers and is primarily described herein with reference to that application. It is however to be understood that it is also applicable to storage of other cryogenic liquid mixtures, for example liquid air, or cryogenic liquids in general, for example liquid argon, liquid hydrogen, liquid helium, liquid nitrogen and liquid oxygen, and to other forms of container, including insulated road tankers, insulated rail tankers and insulated static tanks.

The invention provides a tank management system which can maintain stable conditions within the tank whatever the external ambient conditions or the level of tank loading. The multiple temperature sensing, the number and location of headers and the flow distribution to the different headers enable the appropriate temperature levels to be imposed and maintained at all zones within the tank. By sensing the conditions at different locations within the tank and taking corresponding remedial action it is possible to avoid problems of uncontrolled stratification with liquid layers of differing temperatures and of liquid turnover with sudden pressure rises.

A particular advantage of the invention is that the subcooling, e.g. the refrigeration rate, can be matched to the rate of heat inleak. This means that in ideal conditions little or no evaporation of the stored liquid occurs. The liquid temperature sensors allow the control of the level of refrigeration applied to the withdrawn liquid and the rate and location at which it is reintroduced to be substantially in balance with the heat inleak, and to be adjusted according to changes in the level of heat inleak. The ullage space pressure sensors allow the control of that pressure by controlled rate of vapour condensation, so as to be neither so low as to risk such problems as ingress of external materials or structural damage resulting from a partial vacuum nor so high as to create a risk of unwanted venting or structural damage resulting from undue internal pressures.

The invention further provides advantages in energy consumption in that maintaining most or all of the liquid as such provides a steady and stable thermal state within container. In particular it avoids the much higher energy costs of reliquefying evaporated material and the associated problems caused by the different proportions of constituents in liquid and evaporated LNG mixtures.

Liquid is preferably withdrawn from the container by means of a submerged pump located at or near the base of the container. In an LNG tanker it should be located so as to be within the liquid space in both the laden and unladen states. The pump is preferably operated by the control system since this permits the pump operation to be matched to the prevailing temperature and pressure requirement. It is preferably run continuously since this facilitates the provision of stable storage conditions.

The external refrigeration unit is preferably of an adjustable type and is preferably operated by the control system. The level of refrigeration and thus the extent of subcooling can be then varied by the control system according to the signals received from pressure and temperature sensors.

Although many different adjustable refrigeration cycles may be employed, the preferred choice is a Brayton cycle, for example as disclosed in EP-A-1 120 615. For LNG cooling the preferred refrigerant fluid is nitrogen. In a typical Brayton cycle, the nitrogen working fluid passes repeatedly through a circuit comprising a motor-driven compressor, usually having a plurality of compression stages with intercooling between them, an aftercooler, a heat exchanger, a turboexpander, and a condenser. The turboexpander generates refrigeration by the expansion of the working fluid with the performance of external work, usually in providing part of the energy required to drive the compressor. The turboexpander of the Brayton cycle for this application preferably has an outlet pressure greater than 5 bar and typically in the order of 10 bar, thereby enabling the overall size of the refrigeration unit to be kept down.

The extent of subcooling is dictated by the pump selection and its flow and the by heat inleak required refrigeration rate. A typical subcooling value for a 145,000 $m^3$ LNG carrier for 130 $m^3$/hr pumped flow is 10° K. below the liquefaction temperature of the stored liquid. The pump flow, the liquid subcooling, the refrigeration unit size and turboexpander outlet pressure must be optimized all together.

Preferably all or most of the subcooled liquid is reintroduced into the liquid space. The extent of subcooling and the rate of return of subcooled material can be adjusted such that a sufficient small amount of evaporation occurs to maintain the required ullage space pressure. The provision of a header in the ullage space itself adds a safeguard in permitting direct return of subcooled liquid to the ullage space to condense vapour directly and thereby if so required to restore the required pressure quickly. A single header in the ullage space is usually sufficient.

Although a single header in the liquid space may suffice it is preferred to use more than one header, preferably two or three at different heights within the fully laden container volume. The additional headers provide for additional control of temperature, in particular the temperature gradient, within the stored liquid and thereby assist in maintaining stable liquid storage conditions. In the unladen condition the said additional headers will be in the ullage space and not normally be employed.

The or each of the headers preferably includes multiple spray nozzles. For the ullage space header(s) the spray nozzles are preferably directed downwards to encourage heat exchange with the evaporated material. For the liquid space header(s) the spray nozzles are preferably directed upwards. This means that the reintroduced subcooled liquid, which because of its density tends would tend to fall within the container, is directed upwards to counter the thermosyphon effect caused by wall-heated liquid and thus effects a measure of mixing to assist the provision of a liquid mass free from internal temperature gradients.

A single pressure sensor in the ullage space is normally sufficient to provide the necessary pressure signal for the control system. However it is preferred to have more than one temperature sensor, preferably two or three, in the liquid space so as to indicate any temperature differences within the liquid and thus to permit the control system to adjust the location, volume and/or temperature of reintroduced liquid to restore uniform temperature throughout the stored liquid.

The relative volumes of the liquid and ullage spaces are dictated by the laden or unladen state of the container. With LNG tankers the unladen state retains a volume of liquid both as ballast and to maintain its tanks at low temperature so as to avoid undue evaporation of liquid upon refilling.

The control system is preferably a programmable electronic unit linked by appropriate circuitry to the refrigeration unit, liquid withdrawal means, pressure and temperature sensors and the control valves for the respective headers.

BRIEF DESCRIPTION OF THE DRAWING

The invention will now be described by way of example with reference to the accompanying FIGURE, which is a schematic cross section of an LNG tanker fitted with a control system according to the invention.

DETAILED DESCRIPTION OF THE INVENTION

Figure 1:
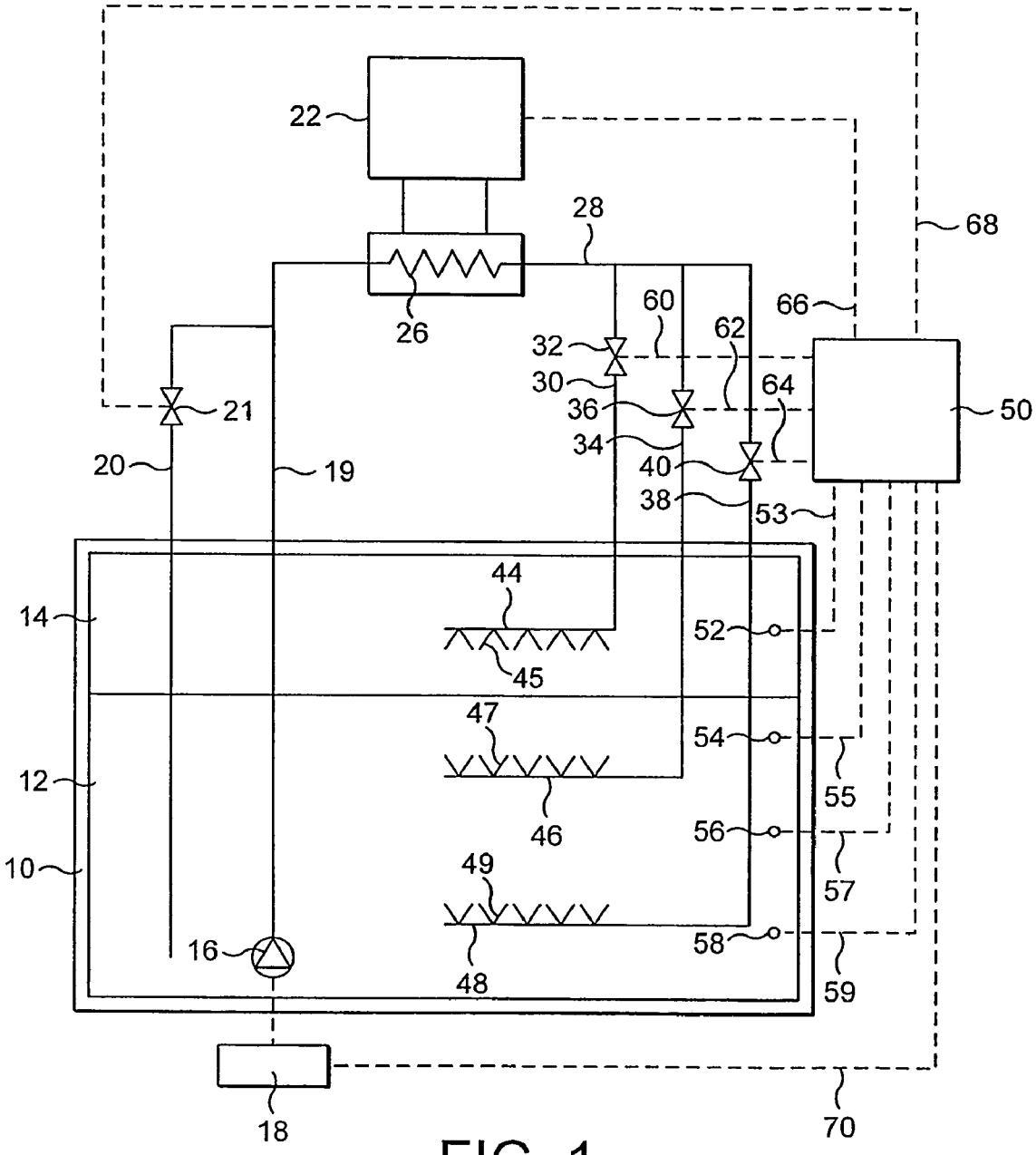

The tanker comprises a double-walled storage tank 10, shown in its fully laden condition with an LNG content 12 and an ullage space 14. A submerged recirculation pump 16 having a variable frequency (variable speed) drive 18 is disposed near the base of the tank 10. An outlet riser 19 is provided from the pump 16 to feed liquid to a heat exchanger 26, which forms part of a refrigeration unit indicated generally by the reference numeral 22. A pipe 20 incorporating a pressure control valve 21 provides a return line from the riser 19 to near the base of the tank 10 to allow liquid to be returned to the tank 10 and thereby assist in controlling the tank pressure, in particular to maintain a constant tank pressure.

The refrigeration unit 22 has an adjustable refrigeration capacity, operating on the Brayton cycle mentioned above and employing nitrogen as the working fluid. Its motor, compressor(s), cooler(s) and turboexpander are not illustrated. It includes a temperature sensor (also not illustrated) to monitor the LNG outlet temperature from the heat exchanger 26.

An outlet line 28 from the heat exchanger 26 branches into three lines 30, 34 and 38, each provided with an adjustable control valve, 32, 36, 40 respectively. Line 30 leads to a spray header 44, with downward-directed spray nozzles 45, located in the ullage space 14. Line 38 leads to a header 48, with upward-directed nozzles 49, located near the base of the tank 10. Because it is customary for a small volume of liquid to be retained in the tank after unloading as ballast and to maintain a low tank temperature the liquid header 48 is normally disposed within liquid for both the outward and return journeys between the LNG loading and unloading ports.

Line 34 leads to a header 46, with upward-directed nozzles 47, located in the upper portion of the liquid when the tank 10 is in the fully laden state. For the return journey after unloading the header 46 is normally within the ullage space.

The control system comprises an tank management unit 50 in the form of a programmable electronic controller, typically located in a cargo control room. A pressure sensor 52 is located in the tank 10 at a point such that it will be in the ullage space 14 regardless of the liquid level. The sensor 52 is linked to the unit 50 by a signal line 53. Three temperature sensors 54, 56, 58 are located in the tank 10 at different levels in the liquid when the tank 10 is in the fully laden condition. For the return journey after unloading the sensors 54 and 56 are normally within the ullage space but the sensor 58 is located so as to be within the ballast liquid. The temperature sensors 54, 56, 58 are linked to the unit 50 by signal lines 55, 57, 59 respectively.

Control lines are provided from the tank management unit 50 to the respective system components. Lines 60, 62, 64 lead to the adjustable control valves 32, 36, 40 respectively. Line 66 leads to the adjustable refrigeration unit 22. Line 68 leads to the pressure control valve 21. Line 70 leads to the variable frequency drive 18 for the pump 16.

In use, the tank management unit 50 receives continuous signals from the pressure sensor 52 and temperature sensors 54, 56 and 58 indicating the conditions at their respective positions in the tank 10. By appropriate control of the operation and/or adjustment of the refrigeration unit 22, the control valves 32, 36, 40 and, for the pump 16, the variable frequency drive 18 and pressure relief valve 21 it is able to maintain the optimum storage conditions within the tank 10 at all levels of liquid.

LNG returned by the pump 16 to the refrigeration unit 22 is maintained by the pressure control valve 21 at a constant head pressure or by the variable speed drive 18 at minimum required head pressure, thus minimizing the pumping power. The LNG is subcooled in the heat exchanger 26 by indirect contact with the cold nitrogen working fluid therein. The subcooled liquid is then returned to the tank 10 via one or more of the headers 44, 46, 48 at a rate which varies according to the tank conditions detected by the pressure and temperature sensors. Typically during laden voyage the upper header 44 is available for spraying, and the middle and lower headers 46 and 48 for liquid mixing. During ballast voyage the headers 44 and 46 are available for spraying, and the lower header 48 for liquid mixing. In many instances it is sufficient to use header 46 alone, thereby adding cold and at the same time imposing an upward liquid movement to counter the thermosyphon effect caused by the relatively warm tank walls.

Flow through the headers 44, 46, 48 is controlled by the respective valves 32, 36, 40 according to the headspace pressure and the liquid temperature, thereby creating a variable load on the refrigeration unit 22. For the unit 22, the variations are met by monitoring the LNG outlet temperature from the heat exchanger 26 and either reducing the power to the unit 22 if the LNG temperature decreases or increasing the power if the LNG temperature increases.

If the pressure sensor 52 detects a fall in the headspace pressure, the volume of LNG being subcooled and returned to the tank 10 is reduced by throttling the return flow by means of one or more of valves 32, 36 and 40 and/or the pump speed by means of the variable frequency drive 18.

I claim:

1. An apparatus for the controlled storage of liquefied gases, comprising an enclosed insulated container providing a liquid space and an ullage space and having an external refrigeration unit, means for withdrawing part of the liquid and feeding the withdrawn part to the external refrigeration unit for subcooling and at least one header for reintroducing the subcooled liquid into the container, the ullage space comprising at least one valve-controlled header and at least one pressure sensor, the liquid space comprising at least two valve-controlled headers at different levels in the liquid space and at least two temperature sensors at different levels in the liquid space, and further comprising a control system linked to the external refrigeration unit, liquid withdrawing means, the pressure and temperature sensors, and the valve-controlled headers to operate the valve-controlled headers in response to signals from the pressure and temperature sensors to adjust a level of refrigeration introduced into the ullage and liquid spaces.

2. The apparatus according to claim 1, wherein said external refrigeration unit is adjustable.

3. The apparatus according to claim 1, wherein said external refrigeration unit comprises a Brayton refrigeration cycle.

4. The apparatus according to claim 1, wherein said valve-controlled headers include multiple spray nozzles.

5. The apparatus according to claim 4, wherein said multiple spray nozzles in the ullage space are directed downwards.

6. The apparatus according to claim 4, wherein said multiple spray nozzles in the liquid space are directed upwards.

7. The apparatus according to claim 1, wherein the means for withdrawing liquid from said container comprises a submerged pump located at or near a base of said container.

8. The apparatus according to claim 7, wherein said submerged pump comprises a variable frequency drive.

9. A method for the controlled storage of liquefied gases in an enclosed insulated container, comprising providing a liquid space and an ullage space, withdrawing part of the liquid, cooling the withdrawn part in an external refrigeration unit to provide a subcooled liquid, reintroducing the subcooled liquid into the container via at least one header, monitoring pressure in the ullage space by at least one pressure sensor therein, monitoring temperature in the liquid space by at least two temperature sensors at different levels in the liquid space, feeding signals from the sensors to a control system, linking said control system to the external refrigeration unit, the pressure and temperature sensors, and valve-controlled headers for operating at least one valve-controlled headers in the ullage space and at least two valve-controlled headers at different levels in the liquid space to reintroduce the subcooled liquid into the ullage space and/or the liquid space as necessary to adjust a level of refrigeration introduced into the ullage and liquid spaces.

10. The method according to claim 9, wherein said external refrigeration unit is adjustable.

11. The method according to claim 9, further comprising varying the level of refrigeration by said control system according to signals received from said pressure and temperature sensors.

12. The method according to claim 9, wherein said external refrigeration cycle comprises a Brayton cycle.

13. The method according to claim 9, wherein said method is employed for LNG cooling by nitrogen.

14. The method according to claim 9, further comprising reintroducing at least most of said subcooled liquid into the liquid space.

15. The method according to claim 14, further comprising adjusting the subcooling and a rate of return of the subcooled liquid such that a sufficient small amount of evaporation occurs for maintaining a required pressure of the ullage space.

16. The method according to claim 9, further comprising reintroducing the subcooled liquid in an upwards direction into liquid stored in the container.

17. The method according to claim 9, further comprising withdrawing liquid from said container with a submerged pump located at or near a base of said container.

18. The method according to claim 17, further comprising operating said submerged pump by the control system to match prevailing temperature and pressure requirements.

19. The method according to claim 17, further comprising continuously running said submerged pump.

20. The method according to claim 17, wherein said submerged pump comprises a variable frequency drive.

* * * * *